US009162124B1

(12) United States Patent
VanNatten et al.

(10) Patent No.: US 9,162,124 B1
(45) Date of Patent: Oct. 20, 2015

(54) GOLF TEE BAG DEVICE

(71) Applicants: Michael VanNatten, Lakeland, FL (US); Janet VanNatten, Lakeland, FL (US)

(72) Inventors: Michael VanNatten, Lakeland, FL (US); Janet VanNatten, Lakeland, FL (US)

( * ) Notice: Subject to any disclaimer, the term of this patent is extended or adjusted under 35 U.S.C. 154(b) by 0 days.

(21) Appl. No.: 14/491,211

(22) Filed: Sep. 19, 2014

(51) Int. Cl.

| | |
|---|---|
| ***B65D 33/14*** | (2006.01) |
| ***A45C 1/04*** | (2006.01) |
| ***A45F 5/02*** | (2006.01) |
| ***A63B 57/00*** | (2015.01) |

(52) U.S. Cl.
CPC ..... *A63B 57/0031* (2013.01); *A63B 57/0075* (2013.01)

(58) Field of Classification Search
CPC ..... A45F 5/02; A45F 5/021
USPC ..... 383/22; 224/587, 240, 904, 918
See application file for complete search history.

(56) References Cited

U.S. PATENT DOCUMENTS

| | | | | | |
|---|---|---|---|---|---|
| 4,047,650 | A * | 9/1977 | Domingos | 224/223 |
| 4,174,793 | A * | 11/1979 | Wisowaty | 224/240 |
| 4,449,310 | A * | 5/1984 | Kline | 40/658 |
| 4,921,153 | A * | 5/1990 | Smith | 224/683 |
| 5,233,942 | A * | 8/1993 | Cooper et al. | 119/792 |
| 5,964,386 | A * | 10/1999 | Cote | 224/250 |
| D449,444 | S * | 10/2001 | Snider | D3/299 |
| 6,651,854 | B1 * | 11/2003 | LaCoste | 224/196 |
| 6,899,257 | B2 * | 5/2005 | Jones | 224/680 |
| 2002/0014507 | A1 * | 2/2002 | Snider et al. | 224/671 |
| 2003/0052143 | A1 * | 3/2003 | Devine | 224/183 |
| 2004/0020959 | A1 * | 2/2004 | Sellars | 224/675 |
| 2005/0284909 | A1 * | 12/2005 | Munoz | 224/674 |
| 2006/0091174 | A1 * | 5/2006 | Mooney | 224/670 |

* cited by examiner

*Primary Examiner* — Jes F Pascua
*Assistant Examiner* — Derek Battisti
(74) *Attorney, Agent, or Firm* — Jason T. Daniel, Esq.; Daniel Law Offices, P.A.

(57) ABSTRACT

A golf tee bag device includes a main body constructed from a single piece of fabric material having a front surface, a back surface and a plurality of edges. The device includes a main pocket area, a horizontal pocket and a pair of connectors for engaging the back surface of the main body in order to attach the device to a belt.

9 Claims, 5 Drawing Sheets

GOLF TEE BAG DEVICE

TECHNICAL FIELD

The present invention relates generally to accessories for use when playing golf, and more particularly to a lightweight golf tee bag which can function to carry a plurality of essential golf tools.

BACKGROUND

The statements in this section merely provide background information related to the present disclosure and may not constitute prior art.

Golf accessories such as tees, divot repair tools and ball markers, for example, are essential to the game of golf. In this regard, a person playing golf must have a golf tee at the ready to complete a nine or eighteen hole game. Likewise, when the ball is located on the green, the golfer must have their ball marker and divot repair tool handy. If any of these items are not readily accessible, the golf game is delayed while the player searches his or her golf bag, or some other location for the missing items. Such a delay of game is typically considered bad etiquette in golf, as it causes the golfing partners, as well as advancing groups of golfers to delay their games while the items are located.

For this reason, many golfers routinely carry their golf accessories in their trouser pockets during game play. However, the act of constantly inserting and retrieving these accessories from the trouser pockets, typically between 25 and 30 times per round, often results in damage to the trousers. Moreover, in many cases, the golfer does not have accessible pockets, and must remember to retrieve the items from the golf cart or golf bag each time they are needed.

Accordingly, it would be beneficial to provide a lightweight golf tee bag which can be secured to a traditional belt, and that can function to simplify the game by providing instant access to the most commonly utilized golf accessories which remain in a central location throughout the entire round of golf.

SUMMARY OF THE INVENTION

The present invention is directed to a golf tee bag device. The device can be formed from a single piece of fabric material having a front surface, a back surface and a plurality of edges. A series of fold lines can separate the main body into four body sections. When folded, the device forms a main pocket suitable for receiving a divot repair tool and a ball marker. A horizontal pocket can be formed along the front of the device and can function to receive a pair of golf tees. The back section of the main body can include a pair of connectors which can function to secure the device onto a belt or other article of clothing.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
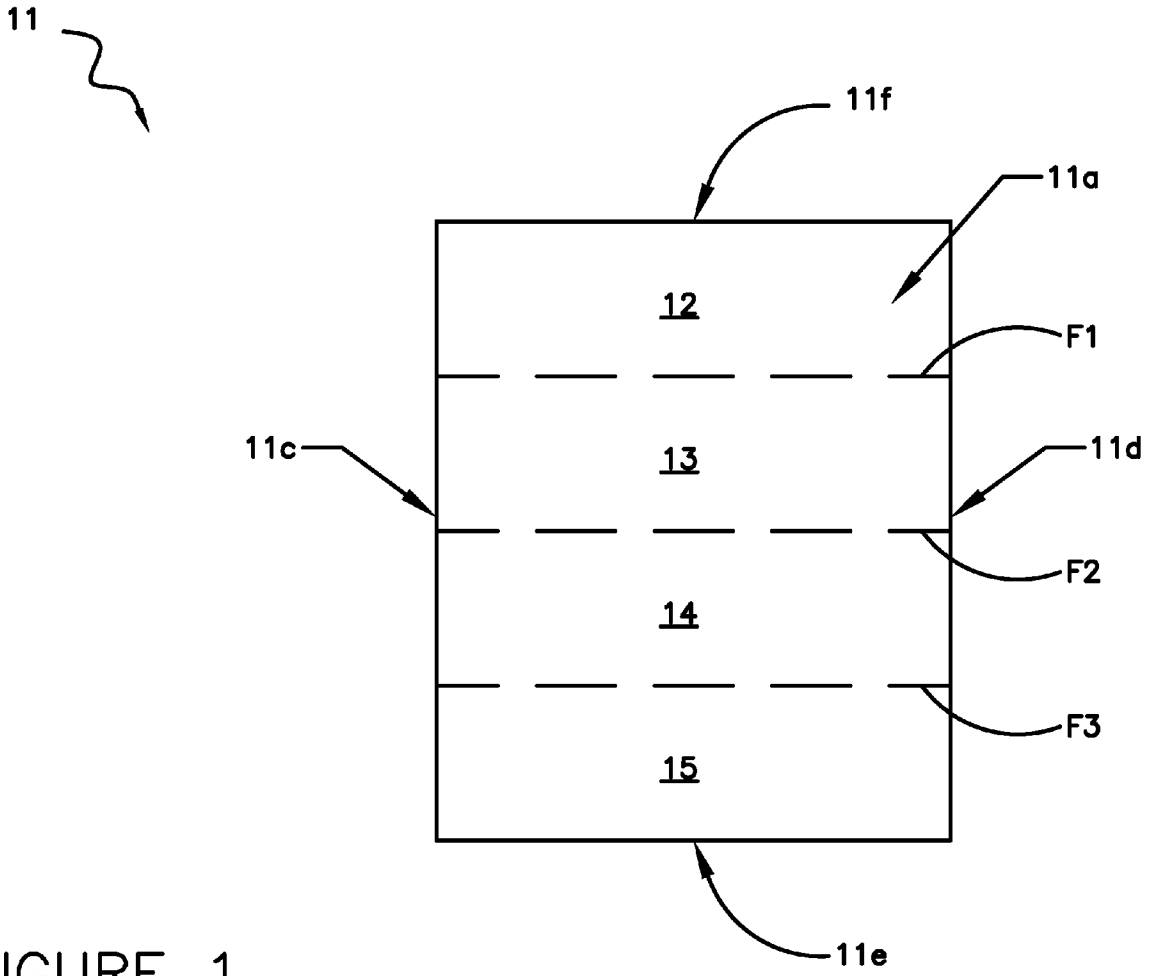
FIG. 1 is a front view of the golf tee bag main body, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 5.

FIGS. 1-5 illustrate one embodiment of a golf tee bag device 10 which can be worn by a user, and can function to provide instant access to the most commonly utilized golf accessories.

As shown in FIG. 1, the device 10 can include a substantially rectangular shaped main body 11 having a front surface 11*a*, a rear surface 11*b* a pair of opposing side edges 11*c* and 11*d*, a bottom edge 11*e*, and a top edge 11*f*. In one embodiment, the main body can further include a plurality of evenly spaced fold lines f1, f2 and f3 extending along the main body and creating four evenly sized main body segments 12, 13, 14 and 15.

As described herein, the main body 11 can preferably be constructed from a generally soft and malleable material such as marine vinyl, for example. Marine vinyl is often manufactured with a smooth finished surface 11*a* and a rough unfinished surface 11*b*. Of course, other forms of vinyl having both finished and unfinished surfaces are also contemplated, as vinyl is a commonly utilized and widely accepted fabric which has hypoallergenic properties that are safe for direct and prolonged contact with humans. Although described above as including a vinyl material, this is for illustrative purposes only, as any number of other lightweight fabric materials can also be utilized herein. These other fabrics can include natural materials such as wool, cotton or cotton blend, for example, or synthetic materials such as polyester, rayon and lightweight plastics, for example.

In one preferred embodiment, the main body 11 can include a length (edges 11*e* to 11*f*) of approximately 8 inches, and a width (edges 11*c* to 11*d*) of approximately 4 inches. Of course, it will be apparent to those skilled in the art, that the exact dimensions of the device body 11 may vary from these amounts without departing from the overall spirit and scope of the present invention.

Figure 2:
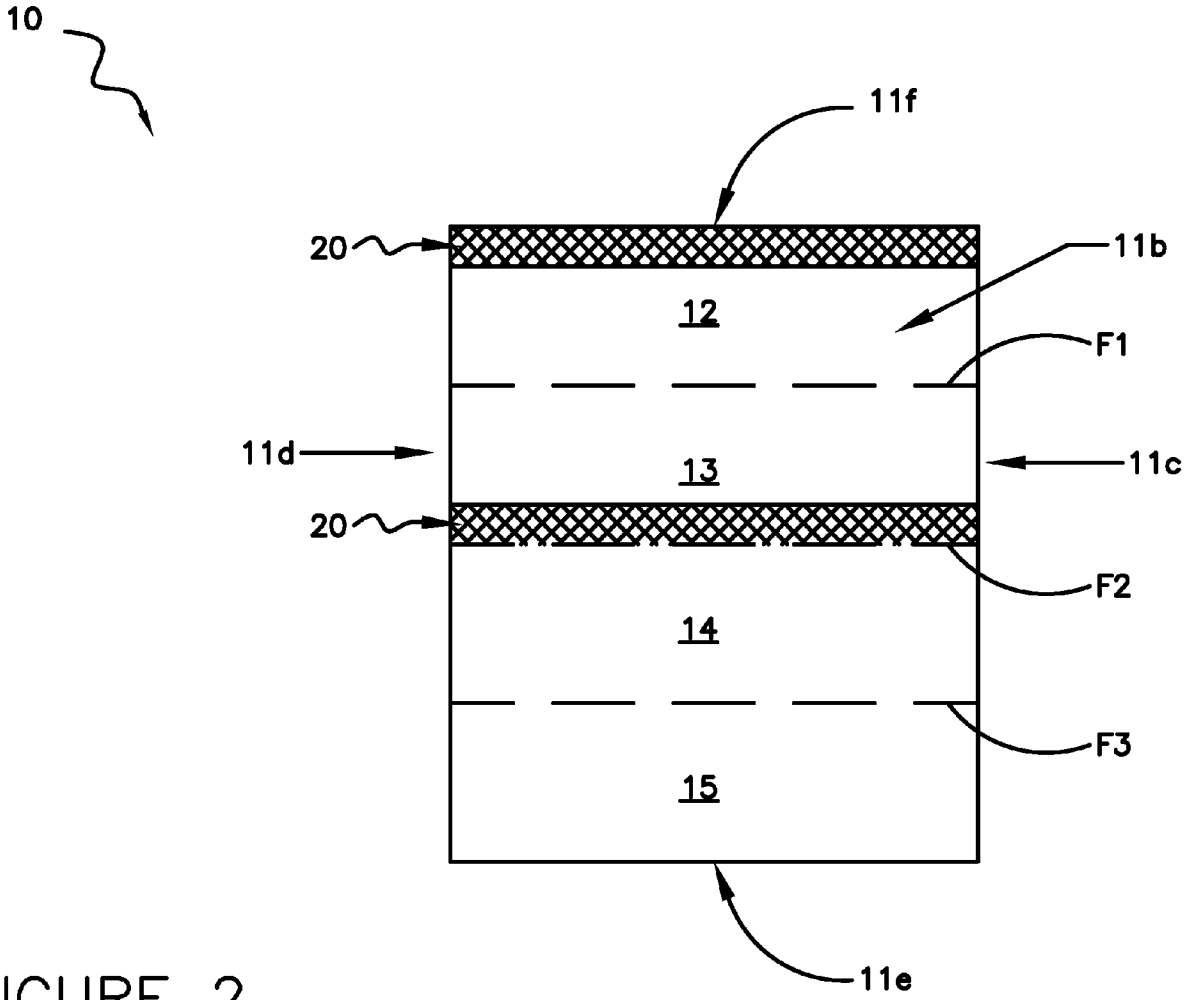
FIG. 2 is a back view of the golf tee bag main body, in accordance with one embodiment of the invention.

As shown best in FIG. 2, the device can further include a pair of attachment units/connectors 20 which can be positioned along the back surface 11*b* of the main body. In the preferred embodiment, each of the attachment units 20 can include one or more strips of hook and loop material (i.e., Velcro®) which can be positioned along main body section 12 adjacent to the top edge 11*f* and along main body section 13 and adjacent to fold line f2. As will be described below, the attachment units can function to selectively engage one another in order to secure main body sections 12 and 13 together in a non-permanent manner so as to allow the device 10 to be secured onto the belt or other article of a user's clothing.

Although described above as including strips of hook and loop material, those of skill in the art will recognize that the attachment units can include any number of known components capable of being removably connected. Several nonlimiting examples include opposing polarity magnets and/or magnetic elements, and compression fittings such as buttons and snaps, for example. Each of these items can be permanently secured to the main body 11 by a permanent sealer such as glue, adhesive tape, or stitching, for example. Moreover, other embodiments are contemplated wherein no connectors are provided, and the above noted sections of the main body can be permanently secured together via stitches or other such materials, thereby forming a permanent opening for receiving a user's belt.

Figure 3:
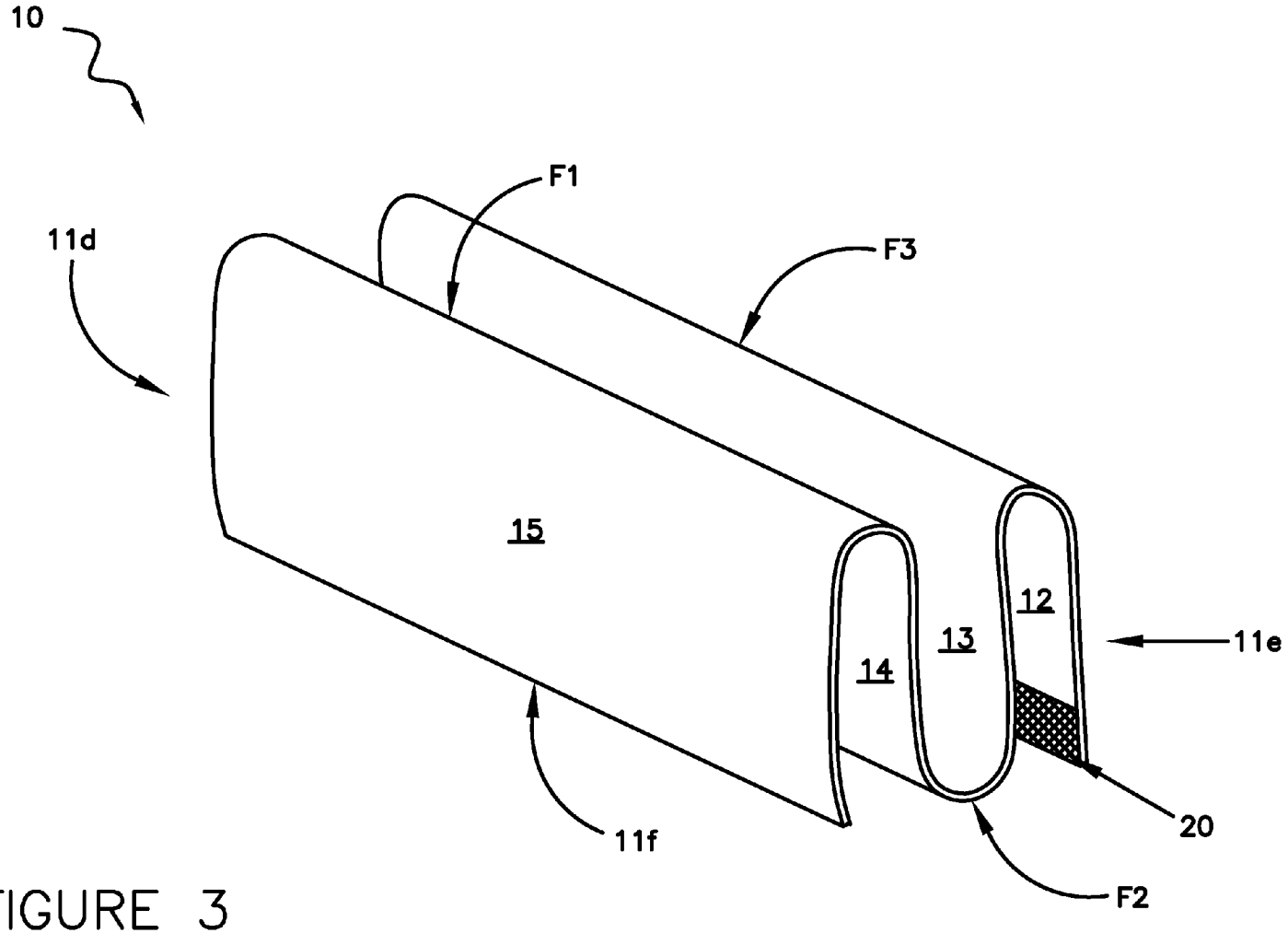
FIG. 3 is a perspective view of the golf tee bag, in accordance with another embodiment of the invention.
Figure 4:
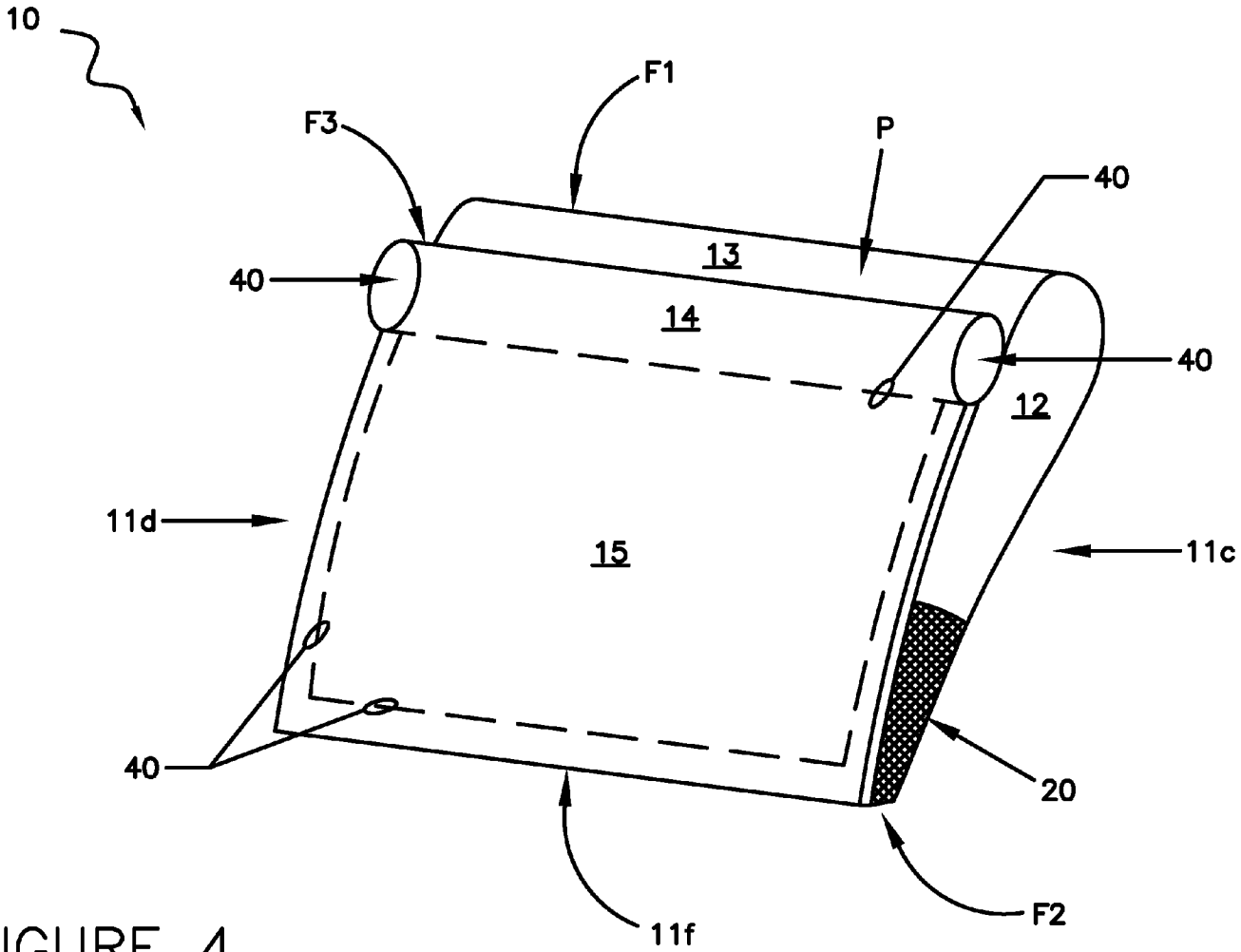
FIG. 4 is another perspective view of the golf tee bag, in accordance with another embodiment of the invention.

As shown in FIG. 3, the main body 11 can be folded along the fold lines f1, f2 and f3, in order to align body segments 12-15 in a generally parallel orientation. At this time, as shown in FIG. 4, main body sections 15, 14 and 13 can be permanently secured together along edges 11*c*, 11*d*, 11*f* and f2, via stitches 40. When so secured, a pocket area P is created between body sections 14 and 13. Additionally, sections 12 and 13 can be removably joined together via the connectors 20 which are aligned due to the above noted folding action. Finally, a second horizontal pocket area H can be formed along the upper periphery of body section 15 adjacent to fold line f3. This horizontal pocket area can further include a pair of openings 41 along each of the side sections 11*c* and 11*d*.

As noted above, the device 10 is intended to be as small and lightweight as possible. As such, it is preferred that the pocket area P include a dimension that is complementary to the dimensions of a traditional divot repair tool, and that the horizontal pocket H include a vertical dimension that is complementary to the diameter of the shaft portion of a golf tee. Although described above as utilizing stitches, this is for illustrative purposes only, as any number of other known means can be utilized, several nonlimiting examples include hem tape and/or liquid sealants, among others, for example.

Figure 5:
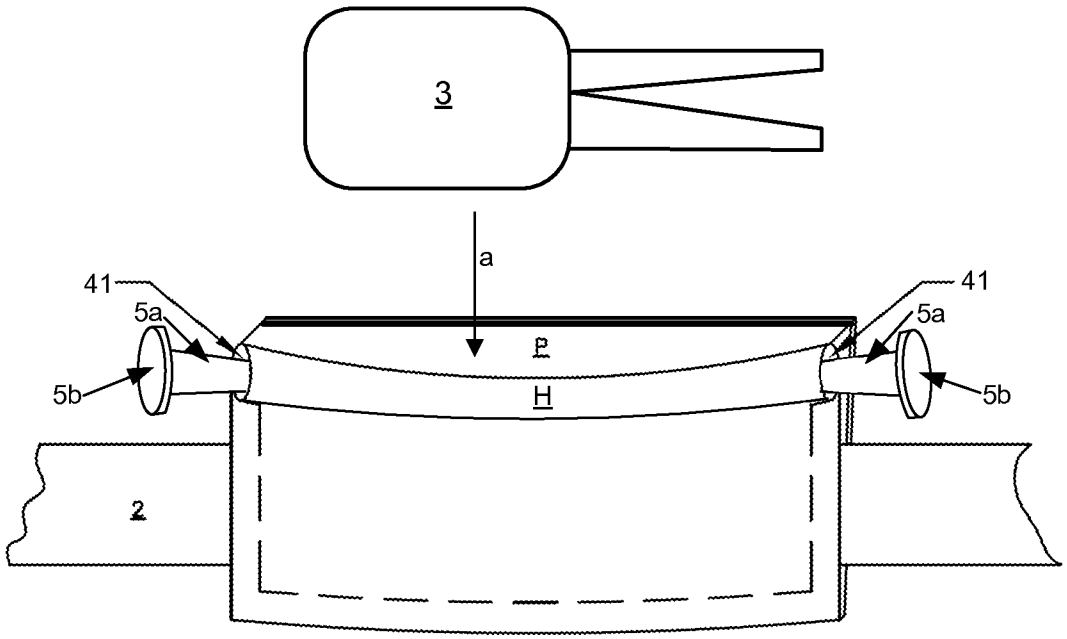
FIG. 5 is a front view of the golf tee bag in operation, and in accordance with another embodiment of the invention.

In operation, and as shown in FIG. 5, the device 10 can be secured onto the belt 2 or other article of clothing by placing the belt between body sections 12 and 13 prior to engaging the connectors 20. As shown by arrow a, the open top end of the pocket area P can receive golf accessories such as a divot repair tool 3 and/or ball markers, for example, and the same can be retrieved without having to open or otherwise manipulate the device 10. Moreover, as the dimension of the horizontal pocket H and the openings 41 are greater than the diameter of the tee shaft 5*a*, and less than the diameter of the tee head 5*b*, the pocket H can securely position two golf tees horizontally, so that the tee shafts are enclosed, and tee heads are not enclosed. Such a feature allows a user to easily store and retrieve the same without having to manipulate the device itself.

By providing a lightweight tee bag device 10, that can be secured onto a user's belt, the presently described invention functions to simplify the game by providing instant access to the most commonly utilized golf accessories in a novel manner.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A golf tee bag device, comprising:

a generally rectangular main body having a front surface, a rear surface, a top edge, a bottom edge and a pair of opposing side edges;

a plurality of fold lines that are disposed along the main body and extending between the pair of opposing side edges, said fold lines functioning to create a first body section, a second body section, a third body section and a fourth body section;

a first attachment unit that is disposed along the rear surface of the first body section adjacent to the top edge, and a second attachment unit that is disposed along the rear surface of the second body section adjacent to one of the fold lines, said first and second attachment units functioning to secure the first and second body sections together in a non-permanent manner;

a first pocket having an open top end, and a dimension that is complementary to a dimension of a divot repair tool, said first pocket being defined by the second and third body sections, the opposing side edges and the bottom edge; and a single elongated horizontal pocket that is formed by the fourth body section and is positioned along an entirety of a top edge of the first pocket, said horizontal pocket further including a pair of horizontally oriented openings that are disposed along each end thereof, said openings being configured to receive and store two golf tees horizontally, wherein each of the second, third and fourth body sections are permanently joined together via a plurality of stitches.

2. The device of claim 1, wherein the main body is constructed from a fabric material.

3. The device of claim 1, wherein the main body is constructed from marine vinyl.

4. The device of claim 1, wherein the first and second attachment units include at least one of opposing strips of hook and loop material, magnetic elements, and compression fittings.

5. The device of claim 1, wherein the first pocket section includes an open top end for receiving the divot repair tool without manipulating the device.

6. The device of claim 1, wherein the main body includes a length of approximately 8 inches.

7. The device of claim 1, wherein the main body includes a width of approximately 4 inches.

8. The device of claim 1, wherein the horizontal pocket and each of the horizontally oriented openings include a dimensions that is suitable for receiving a golf tee shaft within the horizontal pocket, and positioning a golf tee head outside of the horizontal pocket and adjacent to a respective opening.

9. A golf tee bag device, that consists of:

a unitary and generally rectangular main body having a front surface, a rear surface, a top edge, a bottom edge and a pair of opposing side edges;

a plurality of fold lines that are disposed along the main body and extending between the pair of opposing side edges, said fold lines functioning to create a first body section, a second body section, a third body section and a fourth body section;

a first attachment unit that is disposed along the rear surface of the first body section adjacent to the top edge, and a second attachment unit that is disposed along the rear surface of the second body section adjacent to one of the fold lines, said first and second attachment units functioning to secure the first and second body sections together in a non-permanent manner;

a first pocket having an open top end, and a dimension that is complementary to a dimension of a divot repair tool, said first pocket being defined by the second and third body sections, the opposing side edges and the bottom edge; and a single elongated horizontal pocket that is formed by the fourth body section and is positioned along an entirety of a top edge of the first pocket, said horizontal pocket further including a pair of horizontally oriented openings that are disposed along each end thereof, said openings being configured to receive and store two golf tees horizontally, wherein each of the second, third and fourth body sections are permanently joined together via a plurality of stitches.

* * * * *